US006042508A

United States Patent [19]

Clem et al.

[11] Patent Number: 6,042,508

[45] Date of Patent: Mar. 28, 2000

[54] ADJUSTABLE HAND-HELD EXERCISE WEIGHT WITH PULSE DETECTION AND REMOTE INFRARED CONTROL

[75] Inventors: William Clem; Brian Killian, both of Bozeman; Kent Swenseid, Belgrade; Maurene Janke-Hinds, Bozeman, all of Mont.

[73] Assignee: Conetex, Inc., Elverson, Pa.

[21] Appl. No.: 09/250,213

[22] Filed: Feb. 15, 1999

[51] Int. Cl.[7] ..... A63B 23/00

[52] U.S. Cl. ..... 482/4; 482/50; 73/379.03

[58] Field of Search ..... 482/1–9, 44–50, 482/92, 93, 108, 148, 900–902; 73/379.01–379.03

[56] References Cited

U.S. PATENT DOCUMENTS 4,824,103 4/1989 Smidt ..... 482/9

5,076,584 12/1991 Openiano ..... 482/8

5,317,916 6/1994 Kovacevic ..... 73/379.03

*Primary Examiner*—Glenn E. Richman

*Attorney, Agent, or Firm*—Reed Smith Shaw & McClay

[57] ABSTRACT

An adjustable hand-held exercise weight with pulse detection and remote infrared control is disclosed, including a handle contoured for grasping by a user and having a plurality of buttons thereon, a printed circuit board mounted within the handle, a sensor mounted to said printed circuit board which senses a pulse signal, a radio frequency transmitter which transmits the pulse signal, a first slotted bar, a second slotted bar, at least one weight slidably locked in the respective slots between the first and second slotted bars, and an infrared frequency transmitter communicatively connected to the printed circuit board and mounted substantially within the handle. Also disclosed are combinations including at least one of the features of adjustability, pulse detection, and remote infrared control in a hand-held weight.

47 Claims, 4 Drawing Sheets

ADJUSTABLE HAND-HELD EXERCISE WEIGHT WITH PULSE DETECTION AND REMOTE INFRARED CONTROL

CROSS REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention is directed generally to an exercise apparatus using hand-held weights and, more particularly, to an adjustable hand-held exercise weight with pulse detection and remote infrared control.

2. Description of the Background

The hand-held weight has become a staple in the exercise routines of many who engage in jogging or treadmill exercise. However, such hand-held weights can normally be purchased only in certain discrete weight increments, forcing a user to incur great cost to obtain a set of hand-held weights adequate to serve in a varied workout regimen. The few hand-held weights which do allow for weight adjustment are often cumbersome due to their adjustability, limited in their allowance for adjustments, or unreliable in their ability to safely retain the weights placed within them.

It is desirable for a user to track the effects on the body of different exercises in a workout routine. The heartbeat of the user is an excellent gauge of these effects. Users currently must have additional equipment beyond the hand-held exercise weight to monitor heartbeat. This additional equipment may include wires which can become entangled with the user's body during exercise, or separate button-operated equipment which requires the user to move his or her hand or other body part away from a position optimum for the then-current exercise.

It is also desirable for a user to be able to control other equipment used during a workout involving a hand-held exercise weight, such as a treadmill or an entertainment device, without stopping the use of the hand-held exercise weight. Where the use of the hand-held exercise weight must be stopped in order to free the hand of the user to adjust other equipment, valuable exercise time is lost.

Therefore, the need exists for a system which does not require equipment in addition to a hand-held exercise weight to monitor heartbeat information, and which facilitates control over other equipment used during exercising.

BRIEF SUMMARY OF THE INVENTION

The present invention is directed to an adjustable hand-held exercise weight with pulse detection and remote infrared control, which includes a handle contoured for grasping by a user and having a plurality of buttons thereon, a printed circuit board mounted within the handle, a sensor mounted to said printed circuit board which senses a pulse signal, a radio frequency transmitter which transmits the pulse signal, a first slotted bar, a second slotted bar, at least one weight slidably locked in the respective slots between the first and second slotted bars, and an infrared frequency transmitter communicatively connected to the printed circuit board and mounted substantially within the handle. The present invention is also directed to combinations including at least one of the features of adjustability, pulse detection, and remote infrared control in a hand-held weight.

The present invention solves problems experienced with the prior art because it eliminates the need for discrete weight hand-held weights, thereby decreasing user costs, it monitors the effects of exercise on a user's body without the need for additional equipment and without the need for the user to move his or her hand during exercise, and it allows the user to control other equipment, such as a treadmill or an entertainment device, without stopping the exercise routine. Those and other advantages and benefits of the present invention will become apparent from the detailed description of the invention hereinbelow.

BRIEF DESCRIPTION OF THE SEVERAL VIEWS OF THE DRAWING

For the present invention to be clearly understood and readily practiced, the present invention will be described in conjunction with the following figures, wherein.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, many other elements found in a typical hand-held exercise weight. Those of ordinary skill in the art will recognize that other elements are desirable and/or required in order to implement the present invention. However, because such elements are well known in the art, and because they do not facilitate a better understanding of the present invention, a discussion of such elements is not provided herein.

Figure 1:
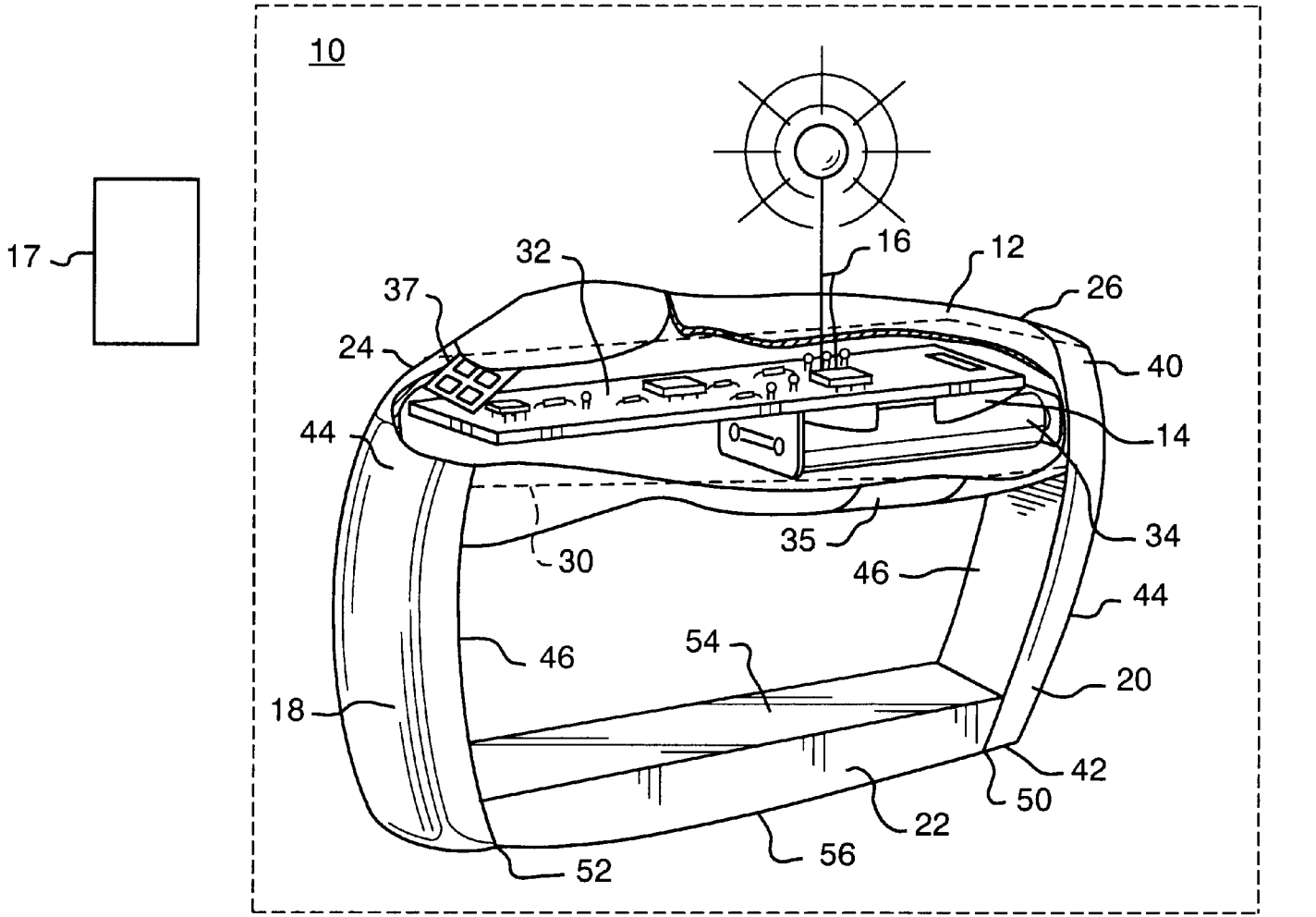
FIG. 1 is an isometric view schematic illustrating a hand-held exercise weight with pulse detection.

FIG. 1 is an isometric view schematic illustrating a handheld exercise weight with pulse detection 10. The hand-held exercise weight with pulse detection includes a handle 12, a sensor 14, a radio frequency transmitter 16, a pair of end bars 18, 20, and at least one weight 22.

The handle 12 is contoured to the shape of a human hand for grasping by a user. The handle 12 has two ends 24, 26, and is substantially rounded along its length. The circumference of the rounded portion of the handle 12 may change from the second end 26 of the handle 12, which receives the heel of the hand, to the first end 24 of the handle 12, which receives the thumb and forefinger of the hand, to provide ease of grasping by the hand of the user. The handle 12 has a hollowed portion 30 within it. The hollowed portion 30 of the handle 12 may be varied in size from a minimum size equivalent to the volume of the pulse sensor 14 to a maximum size equivalent to the total internal volume of the handle 12. In one embodiment of the present invention, the handle 12 includes a printed circuit board 32 mounted within the hollowed portion 30. The printed circuit board 32 is of the type commonly used in the art. The handle 12 may also include at least one battery 34 placed within the hollowed portion 30. This battery 34 may be used to provide power to the pulse sensor 14 and to the printed circuit board 32. The battery 34 may be mounted to the interior of the handle 12 on the hollowed portion 30, or may be mounted to the printed circuit board 32, and the battery 34 is electrically connected to the printed circuit board 32 and to the sensor 14. In the embodiment of the present invention which includes a battery 34, the handle 12 may include a removable plate 35 which, when removed, provides access for the user to the battery 34 or batteries for the purpose of changing the battery 34 or batteries. The removable plate 35 is placed in a position on the handle 12 which provides the user with convenient access to the battery 34 or batteries.

The sensor 14 is used to sense the pulse of the user, and is mounted within the hollowed portion 30 of the handle 12. The sensor 14 is of a type capable of sensing a human pulse through the portion of the handle 12 present between the hand and the sensor 14. The sensor 14 used may be of any type known in the art capable of use in sensing applications, including, but not limited to, a sonic sensor having sensitivity sufficient to detect the sound of a human pulse at the handle, a frequency which has a display unit mounted thereon. The display unit is visible to the user and may display, for example, real time heartbeat rate information to a user during an exercise routine. The display unit may be, but is not limited to, a liquid crystal display (LCD) or a light emitting diode (LED) display. The radio frequency receiver 17 may also be a stand-alone display device visible to the user, such as a television. The radio frequency receiver 17 may also relay the pulse information received to the user in forms other than display, such as audio.

In an alternative embodiment of the present invention, a display unit 37 is formably mounted within the handle 12, rather than at the radio frequency receiver. In this alternative embodiment, the display unit 37 is mounted to allow convenient viewing of heartbeat rate information by the user during an exercise routine. The formably mounted display unit 37 may serve as the radio frequency receiver for the transmission from the radio frequency transmitter 16, or may be in direct communication with the sensor 14. The formably mounted display unit 37 may be, but is not limited to, an LCD or an LED display.

The pair of end bars 18, 20 are connected one to each end of the handle 12. The end bars 18, 20 include a top end 40, a bottom end 42, a front face 44, and a back face 46. The end bars 18, 20 are connected to the handle 12 on the back face 46 at the top end 40. The bottom end 42 at the back face 46 of the sensor having sensitivity sufficient to detect the frequency of a human pulse while not detecting frequency interference without and within the handle, or a pressure sensor having sensitivity sufficient to detect the change in pressure on the handle caused by the occurrence of a human pulse. The sensor 14 may be mounted to the interior of the handle 12 on the hollowed portion 30, or may be mounted to the printed circuit board 32 in an embodiment including a printed circuit board 32.

The radio frequency transmitter 16 transmits the pulse signal received from the sensor 14. The radio frequency transmitter 16 is of the type commonly used in the art. The radio frequency transmitter 16 is in communicative connection with the sensor 14. The radio frequency transmitter 16 is mounted within the hollowed portion 30 of the handle 12, and is either mounted to the interior of the handle 12 on the hollowed portion 30, or to the printed circuit board 32 in an embodiment including a printed circuit board 32. The radio frequency transmitter 16 may extend outside of the handle 12 through a hole extending from the outside of the handle 12, through the handle 12, into the hollowed portion 30. In a preferred embodiment of the present invention, the radio frequency transmitter 16 transmits outside of the handle to a radio frequency receiver 17. The radio frequency receiver 17 may be, but is not limited to, an exercise device, such as a treadmill, end bar 18, 20 may have formed therein a slot which allows slidable locking of weights 22 within the slot.

The weight 22 or weights are connected between the end bars 18, 20 at the bottom end 42 at the back face 46 of each end bar 18, 20. The connection may be a rigid mount or a slidable locking mount. The weights 22 include a right end 50, a left end 52, a top surface 54, and a bottom surface 56. An open volume which approximates a three-dimensional rectangle is formed by the top-most surface 54 of the weights 22, the back faces 46 of the end bars 18, 20, and the lower portion of the circumference of the handle 12. This open rectangle must provide a sufficient volume for the fingers of the hand of the user to pass therethrough when the hand-held exercise weight with pulse detection 10 is grasped by the user.

Figure 2:
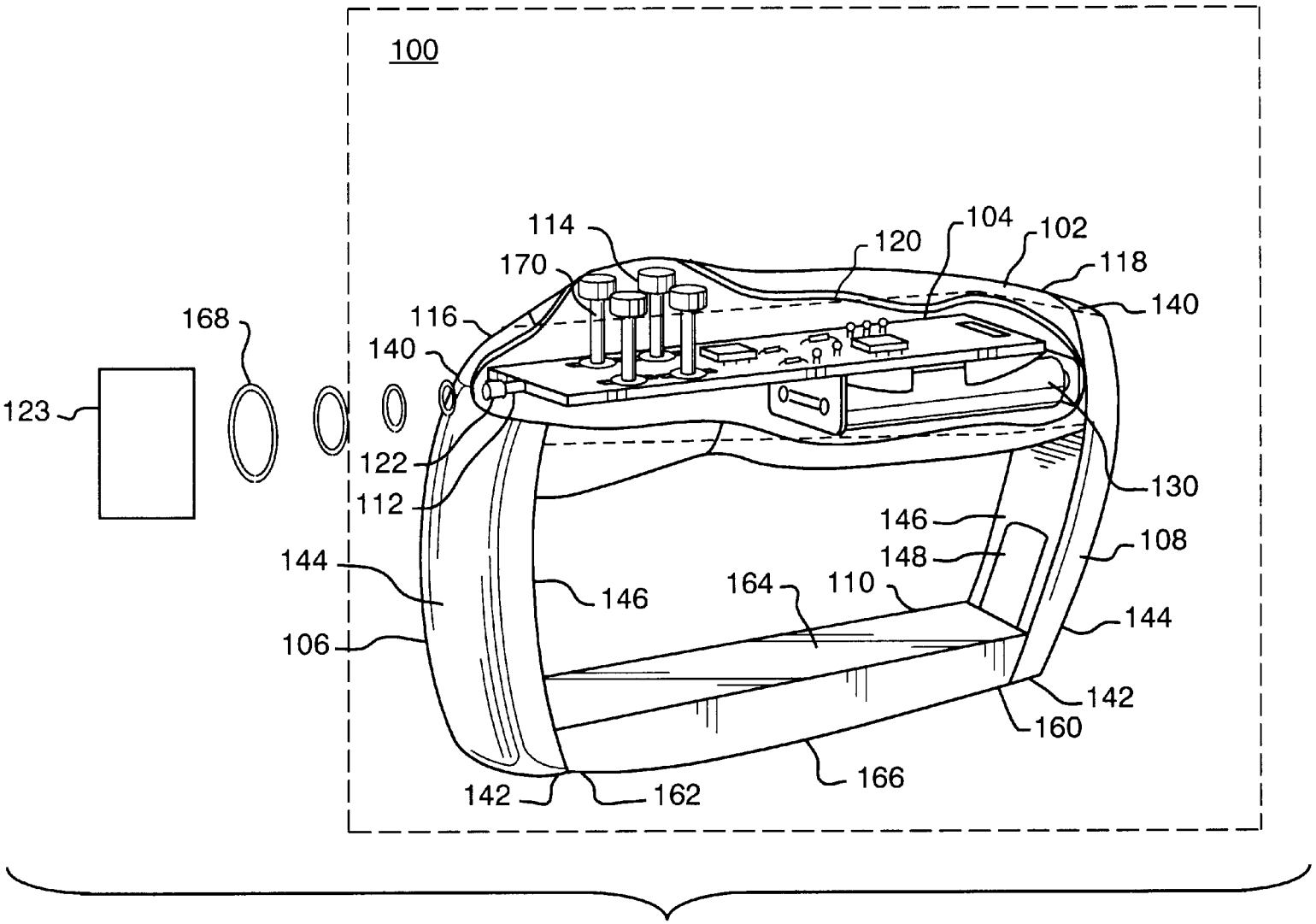
FIG. 2 is an isometric view schematic illustrating a handheld exercise weight with remote infrared control.

FIG. 2 is an isometric view schematic illustrating a handheld exercise weight with remote infrared control 100. The hand-held exercise weight with remote infrared control 100 includes a handle 102, a printed circuit board 104, a pair of end bars 106, 108, at least one weight 110, an infrared frequency transmitter 112, and a plurality of buttons 114.

The handle 102 is contoured to the shape of a human hand for grasping by a user. The handle 102 has two ends 116, 118, and is substantially rounded along its length. The circumference of the rounded portion of the handle 102 may change from the second end 118 of the handle 102, which receives the heel of the hand, to the first end 116 of the handle 102, which receives the thumb and forefinger of the hand, to provide ease of grasping by the hand of the user. The handle 102 has a hollowed portion 120 within it. The hollowed portion 120 of the handle 102 may be varied in size from a minimum size equivalent to the volume of the portion of the infrared frequency transmitter 112 housed within the hollowed portion 120 added to the volume of the printed circuit board 104, to a maximum size equivalent to the total internal volume of the handle 102. The handle 102 also includes a hole 122 at one end 116. In an embodiment of the present invention which includes a battery 130, the handle 102 may include a removable plate which, when removed, provides access for the user to the battery 130 or batteries for the purpose of changing the battery 130 or batteries.

The printed circuit board 104 is of the type known in the art and is mounted within the hollowed portion 120 of the handle 102. At least one battery 130 may be mounted to the printed circuit board 104 within the hollowed portion 120. The printed circuit board 104 is in communicative connection with the infrared frequency transmitter 112, and the battery 130 is electrically connected to the infrared frequency transmitter 112 and the printed circuit board 104.

The pair of end bars 106, 108 are connected one to each end of the handle 102. The end bars 106, 108 include a top end 140, a bottom end 142, a front face 144, and a back face 146. The end bars 106, 108 are connected to the handle 102 on the back face 146 at the top end 140. The bottom end 142 at the back face 146 of the end bar 106, 108 may have formed therein a slot 148 which allows slidable locking of weights 110 within the slot 148.

The weight 110 or weights are connected between the end bars 106, 108 at the bottom end 142 at the back face 146 of each end bar 106, 108. The connection may be a rigid mount or a slidable locking mount. The weights 110 include a right end 160, a left end 162, a top surface 164, and a bottom surface 166. An open volume which approximates a three-dimensional rectangle is formed by the top-most surface 164 of the weights 110, the back faces 146 of the end bars 106, 108, and the lower portion of the circumference of the handle 102. This open rectangle must provide a sufficient volume for the fingers of the hand of the user to pass therethrough when the hand-held exercise weight with pulse detection 100 is grasped by the user.

The infrared frequency transmitter 112 is communicatively connected to the printed circuit board 104 and is mounted substantially within the hollowed portion 120 of the handle 102. The infrared frequency transmitter 112 is of the type commonly used in the art. The infrared frequency transmitter 112 partially extends outside the hollowed portion 120 and through a hole 122 in the handle 102.

The infrared frequency transmitter 112 transmits outside of the handle 102, through the hole 122 in the handle 102, to an infrared frequency receiver 123. The transmission from the infrared frequency transmitter 112 provides a control signal 168 to the infrared frequency receiver 123. The infrared frequency receiver 123 may be, but is not limited to, an entertainment device, such as a television, radio, or video cassette recorder, or an exercise device, such as a treadmill, a stair climbing simulator, or a resistance machine.

The plurality of buttons 114 are communicatively connected within the handle 102 to the printed circuit board 104, which circuit board 104 is, in turn, communicatively connected to the infrared frequency transmitter 112. The plurality of buttons 114 extend outside of the handle 102 through a plurality of holes 170 passing through the handle 102 on the top curve of the circumference on one end 116 of the handle 102. Each button 114 or buttons corresponds to a unique control signal 168 which is to be transmitted from the infrared frequency transmitter 112 to the infrared frequency receiver 123. The infrared frequency receiver 123 is responsive to the control signal 168, and thus is responsive to the pressing of a button 114 by the user. Buttons 114 can be used, for example, to transmit control signals that control an exercise device such as a treadmill by, for example, varying the incline or speed of the treadmill.

Figure 3:
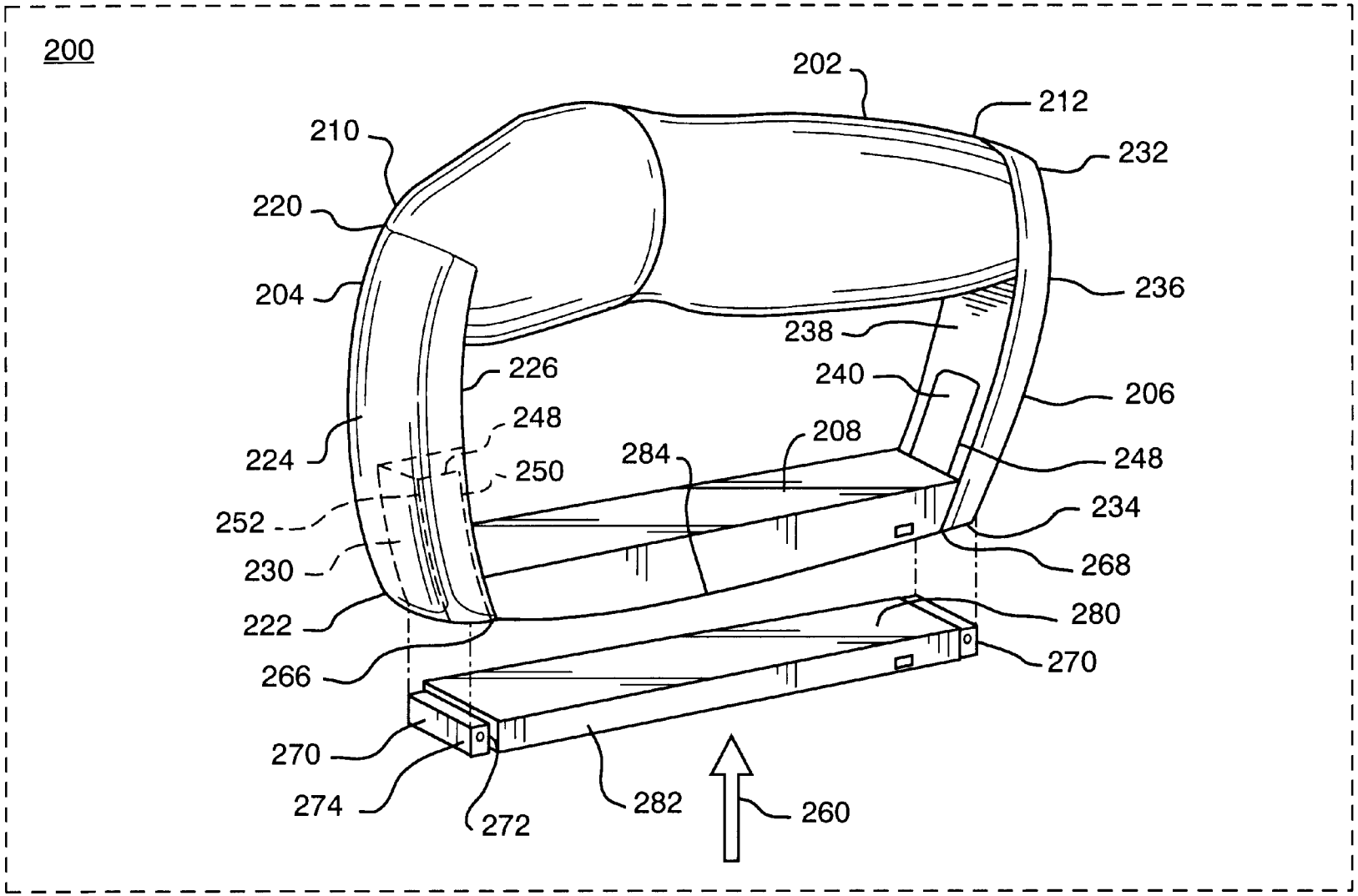
FIG. 3 is an isometric view schematic illustrating an adjustable hand-held exercise weight.

FIG. 3 is an isometric view schematic illustrating an adjustable hand-held exercise weight 200. The adjustable handheld exercise weight 200 includes a handle 202, a first slotted bar 204, a second slotted bar 206, and at least one weight 208.

The handle 202 is contoured to the shape of a human hand for grasping by a user. The handle has two ends 210, 212, and is substantially rounded along its length. The circumference of the rounded portion of the handle 202 may change from the second end 212 of the handle 202, which receives the heel of the hand, to the first end 210 of the handle 202, which receives the thumb and forefinger of the hand, to provide ease of grasping by the hand of the user. The handle 202 may have a hollowed portion within it for housing sensors, transmitters, batteries, or printed circuit boards.

The first slotted bar 204 has two ends 220, 222, a front face 224, and a back face 226. The first end 220 of the first slotted bar 204 is connected to one end 210 of the handle 202 at the back face 226 of the first slotted bar 204. A rectangular slot 230 extends toward the handle 202 along the back face 226 of the first slotted bar 204 from the second end 222 of the first slotted bar 204.

The second slotted bar 206 has two ends 232, 234, a front face 236, and a back face 238. The first end 232 of the second slotted bar 206 is connected to the second end 212 of the handle 202 at the back face 238 of the second slotted bar 206. A rectangular slot 240 extends toward the handle 202 along the back face 238 of the second slotted bar 206 from the second end 234 of the second slotted bar 206.

The rectangular slot present in the first slotted bar 230 and in the second slotted bar 240 has a length from the second end 222, 234 of the slotted bar 204, 206 extending toward the handle 202, a width, and a depth which includes walls 248 along each side of the slot 230, 240 and at the top of the slot 230, 240 nearest the handle 202. The walls 248 include a head 250 and a base 252. In one embodiment of the present invention, the walls 248 have a groove at the base 252. In a preferred embodiment of the present invention, the width of the slot 230, 240 is alternately varied from a width slightly greater than the horizontal surface area of the end of the weight 208 to a width approximately equal to the horizontal surface area of the end of the weight 208, thereby preventing movement of the weight 208 from a slightly greater width region to an approximately equal width region without an application of pressure 260 by the user.

The weight 208 or weights have two ends 266, 268. The ends 266, 268 of the weights 208 are slidably locked into the rectangular slot 230, 240. In one embodiment of the present invention, each end 266, 268 has a lock extender 270 attached thereto. The lock extender 270 is smaller in surface area than the end 266, 268 of the weight 208, and the shape and size of the lock extender 270 corresponds to the shape and depth of the rectangular slot 230, 240 into which the lock extender 270 is slidably locked. The lock extender 270 may include a base 272 and a head 272, and a groove may be present at the base 272 of the lock extender 270 proximate to the point of connection of the lock extender 270 to the end 266, 268 of the weight 208. This lock extender 270 groove allows for interlocking of the head 274 of the lock extender 270 with the groove at the base 252 of the wall 248. The weight of the individual weights 208 may differ depending on the weight desired by the user, although, in a preferred embodiment, the individual weights are less than 2.5 lb.

An open volume which approximates a three-dimensional rectangle is formed by the top-most surface of the weight 208 or weights, the back faces 226, 238 of the slotted bars 204, 206, and the lower portion of the circumference of the handle 202. This open rectangle must provide a sufficient volume for the fingers of the hand of the user to pass therethrough when the adjustable hand-held exercise weight is grasped by the user. The volume of the open rectangle is controlled by the number of weights 208 stacked within the slots 230, 240.

Adjustable weighting of the adjustable hand-held exercise weight 200 is provided by stacking of individual weights 208 to obtain a desired total weight. One end of a first individual weight 208 is placed into the slot 230 of the first slotted bar 204, and the opposing end is placed into the slot 240 of the second slotted bar 206, slidably locking the first weight 208 within the slots 230, 240. The top 280 of a second weight 282 is then pressed by the user against the bottom 284 of the first weight 208, raising the first weight 208 along the length of the slot 230, 240 toward the handle 202 and allowing the ends of the second weight 282 to be slidably locked into the respective slots 230, 240 in the slotted bars 204, 206 below the first weight 208. This vertical stacking is repeated for successive individual weights until a desired total weight for the adjustable hand-held exercise weight 200 is achieved. The maximum number of weights which can be vertically stacked within the slots 230, 240 corresponds to the number of weights having a vertical surface area approximately equal to the entire length of the extension of the slot 230, 240 toward the handle 202. Vertical stacking may also be performed using the lock extenders 270, rather than the ends of the weights directly, in an embodiment having lock extenders 270. In the preferred embodiment of the present invention, the variation in slot width prevents movement of the weight ends or lock extenders 270 from a greater slot width region to an smaller slot width region without an application of pressure 260 by the user. It will be understood by those skilled in the art that the features of adjustable weight 200 may be used in combination with the other embodiments of the invention shown in FIGS. 1,2 and 4.

Figure 4:
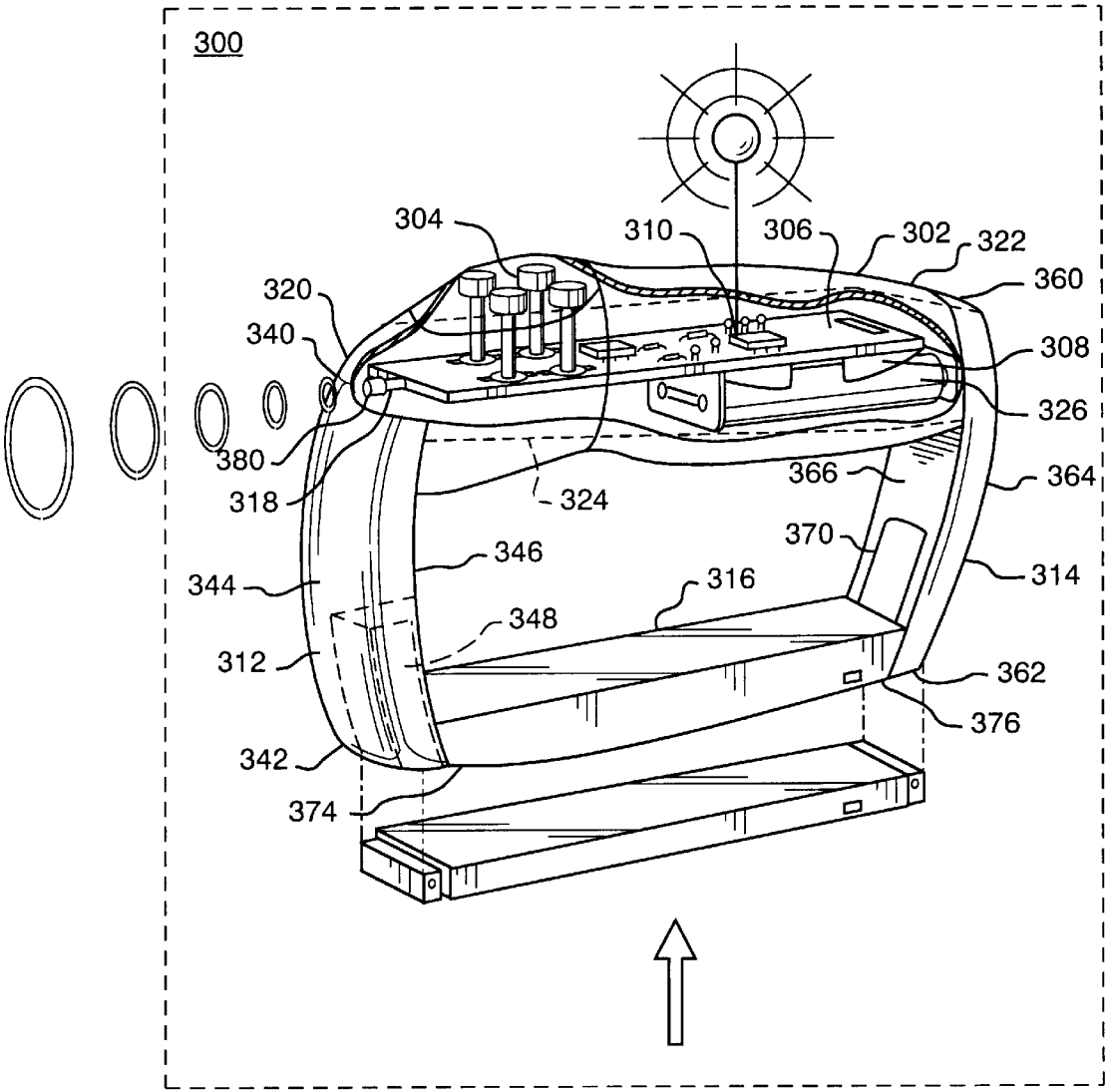
FIG. 4 is an isometric view schematic illustrating an adjustable hand-held exercise weight with pulse detection and remote infrared control.

FIG. 4 is an isometric view schematic illustrating an adjustable hand-held exercise weight with pulse detection and remote infrared control 300. The adjustable hand-held exercise weight with pulse detection and remote infrared control 300 includes a handle 302 with buttons 304 thereon, a printed circuit board 306, a sensor 308, a radio frequency transmitter 310, a first slotted bar 312, a second slotted bar 314, at least one weight 316, and an infrared frequency transmitter 318.

The handle 302 is contoured for grasping by a user and has a plurality of buttons 304 thereon. The handle 302 has a first end 320, a second end 322, and a hollowed portion 324 within the handle 302 between the ends 320, 322. The printed circuit board 306 is mounted within the hollowed portion 324 of the handle 302, and may be powered by at least one battery 326 mounted within the hollowed portion 324 of the handle 302. The buttons 304 on the handle 302 are communicatively connected through the handle 302 to the printed circuit board 306. The sensor 308 is mounted to the printed circuit board 306. The sensor 308 senses a pulse signal, and may sense by sound, pressure, or frequency. The radio frequency transmitter 310 is also mounted to the printed circuit board 306, and transmits the pulse signal from the sensor 308. The handle 302, sensor 308, and radio frequency transmitter 310 are formed and used substantially as discussed above with respect to the hand-held exercise weight with pulse detection 10.

The first slotted bar 312 has two ends 340, 342, a front face 344, and a back face 346. The first end 340 of the first slotted bar 312 is connected to one end 320 of the handle 302 at the back face 346 of the first slotted bar 312. A rectangular slot 348 extends toward the handle 302 along the back face 346 of the first slotted bar 312 from the second end 342 of the first slotted bar 312. The first slotted bar 312 is formed and used substantially as discussed above with respect to the adjustable hand-held exercise weight 200.

The second slotted bar 314 has two ends 360, 362, a front face 364, and a back face 366. The first end 360 of the second slotted bar 314 is connected to one end 322 of the handle 302 at the back face 366 of the second slotted bar 314. A rectangular slot 370 extends toward the handle 302 along the back face 366 of the second slotted bar 314 from the second end 362 of the second slotted bar 314. The second slotted bar 314 is formed and used substantially as discussed above with respect to the adjustable hand-held exercise weight 200.

The weight 316 has two ends 374, 376. The weight 316 is slidably locked on the first end 374 of the weight 316 into the slot 348 of the first slotted bar 312, and on the second end 376 of the weight 316 into the slot 370 of the second slotted bar 314. The weight 316 is formed, used, and stacked substantially as discussed above with respect to the adjustable hand-held exercise weight 200.

The infrared frequency transmitter 318 is communicatively connected to the printed circuit board 306. The infrared frequency transmitter 318 is mounted substantially within the hollowed portion 324 of the handle 302, partially extending outside the hollowed portion 324 and extending through a hole 380 in the handle 302. The infrared frequency transmitter 318 transmits a signal responsive to a pressing by the user of the buttons 304 on the handle 302. The infrared frequency transmitter 318 is formed and used substantially as discussed above with respect to the hand-held exercise weight with remote infrared control 100.

Those of ordinary skill in the art will recognize that many modifications and variations of the present invention may be implemented. For example, different combinations of the elements of the present invention could be implemented, such as an adjustable hand-held exercise weight with remote infrared control, or a hand-held exercise weight with pulse detection and remote infrared control. Further, elements of the present invention, such as the handle and slotted end bars, may be molded as one piece, rather than being connected as separate pieces. The foregoing description and the following claims are intended to cover all such modifications and variations.

What is claimed is:

1. A hand-held exercise weight with pulse detection, comprising:

a handle for grasping by a user, said handle having a first end and a second end and a top side and a bottom side, and having a hollowed portion therein;

a sensor mounted within the hollowed portion which senses a pulse signal;

a radio frequency transmitter which transmits the pulse signal received from said sensor;

a first bar having two ends and having a front face and a back face, wherein the first end of said first bar is connected to the first end of said handle at the back face of said first slotted bar;

a second bar having two ends and having a front face and a back face, wherein the first end of said second bar is connected to the second end of said handle at the back face of said second slotted bar; and at least one weight having two ends, said weight being connected on the first end of said weight to the back face of said first bar at the second end of said first bar, and said weight being connected on the second end of said weight to the back face of said second bar at the second end of said second bar.

2. The hand-held exercise weight with pulse detection of claim 1, wherein said sensor is a sonic sensor.

3. The hand-held exercise weight with pulse detection of claim 1, wherein said sensor is a frequency sensor.

4. The hand-held exercise weight with pulse detection of claim 1, wherein said sensor is a pressure sensor.

5. The hand-held exercise weight with pulse detection of claim 1, wherein said radio frequency transmitter is mounted within the hollowed portion.

6. The hand-held exercise weight with pulse detection of claim 1, wherein said radio frequency transmitter transmits to a radio frequency receiver.

7. The hand-held exercise weight with pulse detection of claim 6, wherein said radio frequency receiver is an exercise device.

8. The hand-held exercise weight with pulse detection of claim 7, wherein said exercise device includes a display unit visible to the user.

9. The hand-held exercise weight with pulse detection of claim 8, wherein said display unit is an LCD display unit.

10. The hand-held exercise weight with pulse detection of claim 8, wherein said display unit is an LED display unit.

11. The hand-held exercise weight with pulse detection of claim 8, wherein said exercise device is a treadmill.

12. The hand-held exercise weight with pulse detection of claim 1, further comprising a printed circuit board mounted within the hollowed portion.

13. The hand-held exercise weight with pulse detection of claim 12, further comprising at least one battery mounted within the hollowed portion, which battery provides power to said sensor and said printed circuit board.

14. The hand-held exercise weight with pulse detection of claim 13, wherein said handle includes a removable plate removably fastened thereto, said removable plate allowing the user to gain access to said battery when said removable plate is removed.

15. The hand-held exercise weight with pulse detection of claim 13, wherein said battery is mounted to said printed circuit board.

16. The hand-held exercise weight with pulse detection of claim 12, wherein said sensor is mounted to said printed circuit board.

17. The hand-held exercise weight with pulse detection of claim 12, wherein said radio frequency transmitter is mounted to and in communicative connection with said printed circuit board.

18. The hand-held exercise weight with pulse detection of claim 12, further comprising an infrared frequency transmitter communicatively connected to said printed circuit board and mounted substantially within the hollowed portion, partially extending outside the hollowed portion and extending through a hole in said handle.

19. The hand-held exercise weight with pulse detection of claim 18, wherein said infrared frequency transmitter transmits outside of said handle to an infrared frequency receiver.

20. The hand-held exercise weight with pulse detection of claim 19, wherein the transmission from said infrared frequency transmitter provides a control signal to said infrared frequency receiver.

21. The hand-held exercise weight with pulse detection of claim 20, wherein said infrared frequency receiver controlled by the control signal is an entertainment device.

22. The hand-held exercise weight with pulse detection of claim 21, wherein said entertainment device is chosen from the group consisting of a television, a radio, and a video cassette recorder.

23. The hand-held exercise weight with pulse detection of claim 20, wherein said infrared frequency receiver controlled by the control signal is an exercise device.

24. The hand-held exercise weight with pulse detection of claim 23, wherein said exercise device is chosen from the group consisting of a treadmill, a stair climbing simulator, and a resistance machine.

25. The hand-held exercise weight with pulse detection of claim 20, further comprising a plurality of buttons communicatively connected to said printed circuit board, which printed circuit board is communicatively connected to said infrared frequency transmitter, said plurality of buttons extending outside of said handle through a plurality of holes passing through said handle on the first end of said handle.

26. The hand-held exercise weight with pulse detection of claim 25, wherein each button corresponds to a control signal which is to be transmitted from said infrared frequency transmitter.

27. The hand-held exercise weight with pulse detection of claim 1, further comprising a display portion formably mounted within said handle for display of said pulse signal, said display portion being mounted to allow viewing by the user during use, and said display portion being in communicative connection with said sensor.

28. The hand-held exercise weight with pulse detection of claim 1, wherein said first bar includes a rectangular slot extending toward said handle along the back face of said first bar from the second end of said first bar, and wherein said second bar includes a rectangular slot extending toward said handle along the back face of said second bar from the second end of said second bar, and wherein said weight is slidably locked on the first end of said weight into the slot of said first bar, and said weight is slidably locked on the second end of said weight into the slot of said second bar.

29. The hand-held exercise weight with pulse detection of claim 28, wherein the slidable lock is an alternate variation in the rectangular slot from a width slightly greater than the horizontal surface area of the end of said weight to a width approximately equal to the horizontal surface area of the end of said weight, thereby preventing movement of the ends of said weight from a slightly greater width region to an approximately equal width region without an application of pressure by the user.

30. An adjustable hand-held exercise weight, comprising:

a handle for grasping by a user, said handle having a first end and a second end;

a first slotted bar having two ends and having a front face and a back face, wherein the first end of said first slotted bar is connected to the first end of said handle at the back face of said first slotted bar, and wherein a rectangular slot extends toward said handle along the back face of said first slotted bar from the second end of said first slotted bar;

a second slotted bar having two ends and having a front face and a back face, wherein the first end of said second slotted bar is connected to the second end of said handle at the back face of said second slotted bar, and wherein a rectangular slot extends toward said handle along the back face of said second slotted bar from the second end of said second slotted bar; and at least one weight having two ends, said weight being slidably locked on the first end of said weight into the slot of said first slotted bar, and said weight being slidably locked on the second end of said weight into the slot of said second slotted bar.

31. The adjustable hand-held exercise weight of claim 30, having at least two weights, wherein the first ends of said weights are vertically stacked within the slot of said first slotted bar, and wherein the second ends of said weights are vertically stacked within the slot of said second slotted bar.

32. The adjustable hand-held exercise weight of claim 31, wherein each vertically stacked end has a corresponding surface area, and wherein a maximum number of stacked weights corresponds to a number of weights having a vertical surface area approximately equal to a length corresponding to the extension of the slot toward said handle.

33. The adjustable hand-held exercise weight of claim 30, wherein the weight of at least one weight is less than 1 lb.

34. The adjustable hand-held exercise weight of claim 30, wherein the weight of at least one weight is in the range between 1 lb and 2.5 lb.

35. The adjustable hand-held exercise weight of claim 30, wherein the ends of each weight include a lock extender, said lock extender being smaller in surface area than the end of said weight, and corresponding in shape to the slot into which said lock extender is placed.

36. The adjustable hand-held exercise weight of claim 35, wherein said lock extender includes a base and a head, and wherein said lock extender includes a groove at the base proximate to a point of connection to the end of said weight.

37. The adjustable hand-held exercise weight of claim 36, wherein the slot includes walls along the sides of the slot, and wherein said walls include a head and a base, and wherein said walls have a groove at the base for interlocking with the head of the lock extender, and wherein the head of said walls interlocks with the groove on the base of said lock extender.

38. The adjustable hand-held exercise weight of claim 35, wherein the slot has a length and a width, and wherein the width of the slot is alternately varied from a width slightly greater than the horizontal surface area of said lock extender to a width approximately equal to the horizontal surface area of said lock extender, thereby preventing movement of the lock extender from a slightly greater width region to an approximately equal width region without an application of pressure by the user.

39. An hand-held exercise weight with remote infrared control, comprising:

a handle for grasping by a user and having a plurality of buttons thereon, said handle having a first end and a second end, and having a hollowed portion therein;

a printed circuit board mounted within the hollowed portion and in communicative connection with the buttons;

a first bar having two ends and having a front face and a back face, wherein the first end of said first bar is connected to the first end of said handle at the back face of said first bar;

a second bar having two ends and having a front face and a back face, wherein the first end of said second bar is connected to the second end of said handle at the back face of said second bar;

at least one weight having two ends, said weight being connected on the first end of said weight to said first bar, and said weight being connected on the second end of said weight to said second bar; and an infrared frequency transmitter communicatively connected to said printed circuit board and mounted substantially within the hollowed portion, partially extending outside the hollowed portion and extending through a hole in said handle, which infrared frequency transmitter transmits a signal responsive to a pressing by the user of the buttons on said handle.

40. The hand-held exercise weight with remote infrared control of claim 39, wherein said infrared frequency transmitter transmits the responsive signal to an infrared frequency receiver.

41. The hand-held exercise weight with remote infrared control of claim 40, wherein the transmission from said infrared frequency transmitter provides a control signal to said infrared frequency receiver.

42. The hand-held exercise weight with remote infrared control of claim 41, wherein each button corresponds to a unique control signal which is to be transmitted from said infrared frequency transmitter to said infrared frequency receiver.

43. An adjustable hand-held exercise weight with pulse detection and remote infrared control, comprising:

a handle for grasping by a user and having a plurality of buttons thereon, said handle having a first end and a second end, and having a hollowed portion therein;

a printed circuit board mounted within the hollowed portion;

a sensor mounted to said printed circuit board which senses a pulse signal;

a radio frequency transmitter which transmits the pulse signal from said sensor;

a first slotted bar having two ends and having a front face and a back face, wherein the first end of said first slotted bar is connected to the first end of said handle at the back face of said first slotted bar, and wherein a rectangular slot extends toward said handle along the back face of said first slotted bar from the second end of said first slotted bar;

a second slotted bar having two ends and having a front face and a back face, wherein the first end of said second slotted bar is connected to the second end of said handle at the back face of said second slotted bar, and wherein a rectangular slot extends toward said handle along the back face of said second slotted bar from the second end of said second slotted bar;

at least one weight having two ends, said weight being slidably locked on the first end of said weight into the slot of said first slotted bar, and said weight being slidably locked on the second end of said weight into the slot of said second slotted bar; and an infrared frequency transmitter communicatively connected to said printed circuit board and mounted substantially within the hollowed portion, partially extending outside the hollowed portion and extending through a hole in said handle, which infrared frequency transmitter transmits a signal responsive to a pressing by the user of the buttons on said handle.

44. The adjustable hand-held exercise weight with pulse detection and remote infrared control of claim 43, wherein said handle, said first slotted bar, and said second slotted bar are molded as one unit.

45. The adjustable hand-held exercise weight with pulse detection and remote infrared control of claim 43, wherein said handle has a circumference, and wherein said circumference is non-constant.

46. An adjustable hand-held exercise weight with pulse detection and remote infrared control, comprising:

a handle for grasping by a user, said handle having a first end and a second end, and having a hollowed portion therein;

a printed circuit board mounted within the hollowed portion;

a pulse sensor mounted to said printed circuit board;

a first slotted bar having two ends and having a front face and a back face, wherein the first end of said first slotted bar is connected to the first end of said handle at the back face of said first slotted bar, and wherein said first slotted bar includes a means for slidable locking;

a second slotted bar having two ends and having a front face and a back face, wherein the first end of said second slotted bar is connected to the second end of said handle at the back face of said second slotted bar, and wherein said second slotted bar includes a means for slidable locking;

at least one weight having two ends, said weight being slidably locked on the first end of said weight into the means for slidable locking of said first slotted bar, and said weight being slidably locked on the second end of said weight into the means for slidable locking of said second slotted bar; and an infrared frequency transmitter communicatively connected to said printed circuit board and mounted substantially within the hollowed portion, partially extending outside the hollowed portion and extending through a hole in said handle, which infrared frequency transmitter transmits a signal responsive to a control means mounted to said handle.

47. A hand-held exercise weight with pulse detection, comprising:

a handle for grasping by a user, said handle having a first end and a second end and a top side and a bottom side, and having a hollowed portion therein;

a sensor mounted within the hollowed portion which senses a pulse signal;

a display portion formably mounted within said handle for display of said pulse signal, said display portion being mounted to allow viewing by the user during use, and said display portion being in communicative connection with said sensor;

a first bar having two ends and having a front face and a back face, wherein the first end of said first bar is connected to the first end of said handle at the back face of said first slotted bar;

a second bar having two ends and having a front face and a back face, wherein the first end of said second bar is connected to the second end of said handle at the back face of said second slotted bar; and at least one weight having two ends, said weight being connected on the first end of said weight to the back face of said first bar at the second end of said first bar, and said weight being connected on the second end of said weight to the back face of said second bar at the second end of said second bar.

* * * * *